US007266206B2

(12) United States Patent
Ju

(10) Patent No.: US 7,266,206 B2
(45) Date of Patent: Sep. 4, 2007

(54) CHANNEL DOWN MIXING APPARATUS FOR CAR AUDIO SYSTEM

(75) Inventor: Beom-Jun Ju, Seoul (KR)

(73) Assignee: Hyundai Autonet Co., Ltd., Icheon-si (KR)

( * ) Notice: Subject to any disclaimer, the term of this patent is extended or adjusted under 35 U.S.C. 154(b) by 718 days.

(21) Appl. No.: 10/725,492

(22) Filed: Dec. 3, 2003

(65) Prior Publication Data

US 2005/0084119 A1 Apr. 21, 2005

(30) Foreign Application Priority Data

Oct. 16, 2003 (KR) ..... 10-2003-0072112

(51) Int. Cl.
*H04B 1/00* (2006.01)

(52) U.S. Cl. ..... 381/119; 369/6; 369/2; 381/119

(58) Field of Classification Search ..... 381/119, 381/86, 18, 19, 120, 27, 99; 369/6, 2, 10
See application file for complete search history.

(56) References Cited

U.S. PATENT DOCUMENTS 4,433,209 A * 2/1984 Kurosawa et al. ..... 381/1
4,434,325 A * 2/1984 Kobayashi et al. ..... 381/104
4,453,264 A * 6/1984 Hochstein ..... 381/110
4,675,905 A * 6/1987 Flora et al. ..... 381/81
5,321,671 A * 6/1994 Yoshida ..... 369/6
5,440,643 A * 8/1995 Wilson et al. ..... 381/119
5,673,327 A * 9/1997 Julstrom ..... 381/119
6,681,018 B1 * 1/2004 Asakura et al. ..... 381/18
2003/0039373 A1 * 2/2003 Lawson et al. ..... 381/119

* cited by examiner

*Primary Examiner*—Vivian Chin
*Assistant Examiner*—Disler Paul
(74) *Attorney, Agent, or Firm*—Greenblum & Bernstein, P.L.C.

(57) ABSTRACT

The present invention relates to a channel down mixing apparatus for a car audio system for reducing manufacture cost and switching noise by implementing a sub-woofer down mixing portion, a buffer portion and a switching circuit portion to one body with an application of simple circuit elements thereto. The channel down mixing apparatus for a car audio system, having a channel down mixing function for down mixing a sub-woofer signal to an L (left) channel and an R (right) channel when a user does not select a sub-woofer speaker, includes: a pair of buffers for amplifying an L channel input signal and an R channel input signal to a designated gain, respectively; a pair of FETs for mixing the sub-woofer signal with the L channel input signal and the R channel input signal when the user does not select the sub-woofer speaker, and for outputting a mixed signal to each of the buffers; a first transistor being turned on when the user turns on the sub-woofer speaker; and a second transistor and a third transistor, which are turned off when the first transistor is turned on and turned off when the first transistor is turned on, reducing the L channel input signal and the R channel input signal to a designated level, respectively.

14 Claims, 1 Drawing Sheet

[FIG. 1]
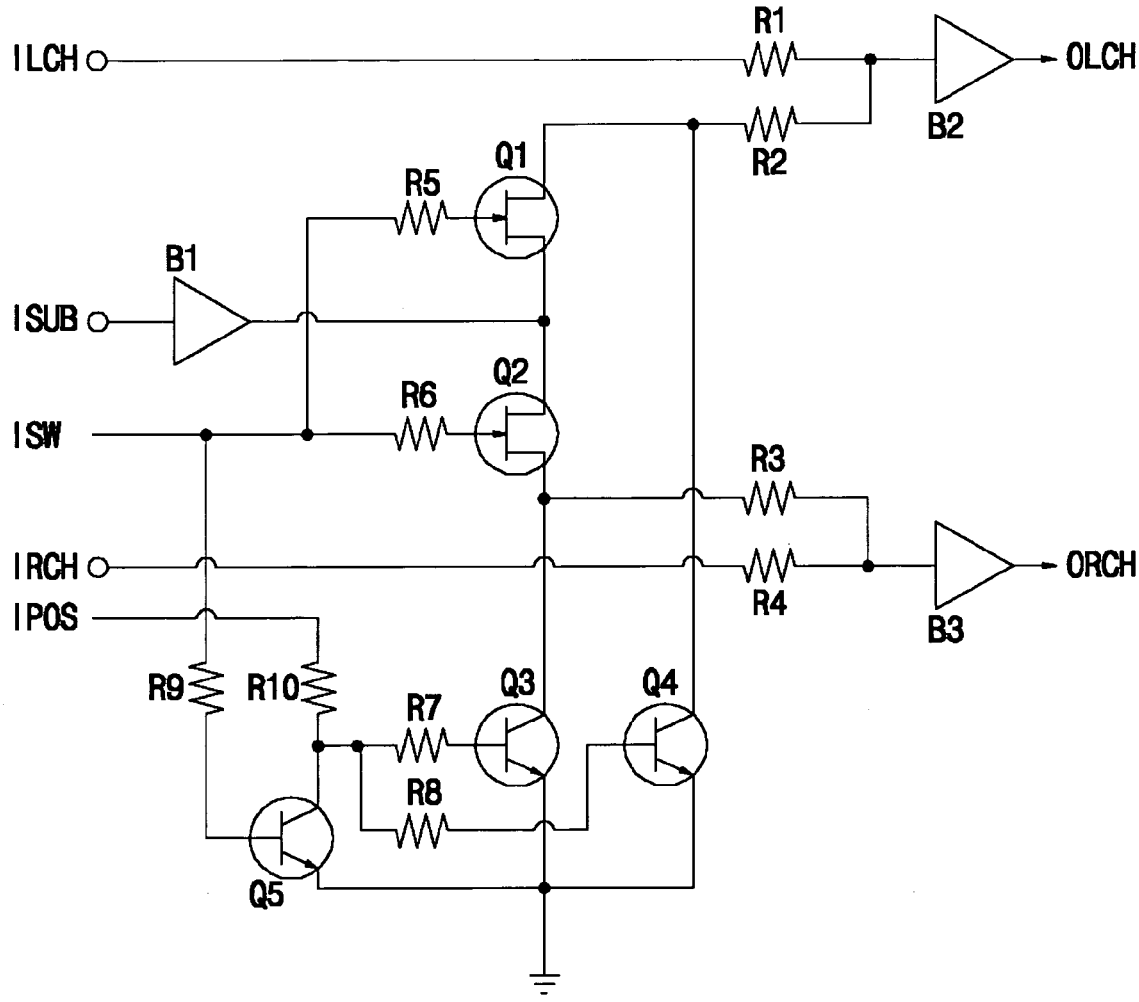

CHANNEL DOWN MIXING APPARATUS FOR CAR AUDIO SYSTEM

RELATED APPLICATIONS

The present disclosure relates to subject matter contained in priority Korean Application No. 10-2003-0072112, filed on Oct. 16, 2003, which is herein expressly incorporated by reference in its entirety.

BACKGROUND OF THE INVENTION

1. Field of the Invention

The present invention is related to a channel down mixing apparatus for a car audio system, more specifically, to a channel down mixing apparatus for a car audio system having a simple structure.

2. Description of the Related Art

In recent years, as people spend much time in their cars (i.e., driving to work every weekday, traveling etc.), there are a lot of interests in safety and convenience equipments that can be mounted on the cars. One of them is a car audio system for providing better stereo sounds to passengers. Typically, a multi-channel play system, e.g., 5.1-channel play system, is used. The 5.1-channel play system reproduces respective channel sounds through five speakers that are positioned on the front side (for example, the left, right and central portions) and on the rear side (for example, the left and right portions) of a listener. The 5.1-channel play system is capable of reproducing more realistic stereo sounds by emphasizing a medium low sound band through a sub-woofer speaker.

The sub-woofer speaker can be turned on or off, depending on users' taste or favorite. The word 'channel down mixing' means integrating multi channels to a less number of channels, i.e., integrating a 5.1- channel sound track to 2-channel sound track, when multi speakers are not available. Another meaning of the 'channel down mixing' is mixing sub-woofer signals to a main channel when a user does not want the sub-woofer speaker to output sound. In the present invention, the 'channel down mixing' has the meaning of the later case.

However, according to a related art channel down mixing apparatus for a car audio system, the circuit used in the apparatus has a very complex structure mainly because the apparatus has a two-step buffer circuit, namely a down mixing portion and a buffer portion, and uses a separate IC to turn on/off the sub-woofer speaker, thereby increasing manufacture cost of the product. Another disadvantage of the related art apparatus is that it produces switching noise when blocking a sub-woofer signal, which is a low-frequency signal.

SUMMARY OF THE INVENTION

It is, therefore, an object of the present invention to provide a channel down mixing apparatus for a car audio system for reducing manufacture cost and switching noise by implementing a sub-woofer down mixing portion, a buffer portion and a switching circuit portion to one body with an application of simple circuit elements thereto.

To achieve the above object, there is provided a channel down mixing apparatus for a car audio system, which has a channel down mixing function for down mixing a sub-woofer signal to an L (left) channel and an R (right) channel when a user does not select a sub-woofer speaker, the apparatus including: a pair of buffers for amplifying an L channel input signal and an R channel input signal to a designated gain, respectively; a pair of FETs for mixing the sub-woofer signal with the L channel input signal and the R channel input signal when the user does not select the sub-woofer speaker, and for outputting a mixed signal to each of the buffers; a first transistor being turned on when the user turns on the sub-woofer speaker; and a second transistor and a third transistor, which are turned off when the first transistor is turned on and turned off when the first transistor is turned on, reducing the L channel input signal and the R channel input signal to a designated level, respectively.

BRIEF DESCRIPTION OF THE DRAWINGS

The above objects, features and advantages of the present invention will become more apparent from the following detailed description when taken in conjunction with the accompanying drawings, in which:

FIG. 1 is a circuit diagram of a channel down mixing apparatus for a car audio system according to a preferred embodiment of the present invention.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

FIG. 1 is a circuit diagram of a channel down mixing apparatus for a car audio system according to a preferred embodiment of the present invention. As illustrated in FIG. 1, the channel down mixing apparatus for a car audio system of the present invention includes a one-stage buffer, two FETs (Field Effect Transistor) elements, and other simple circuit parts. More specifically, a L (left) channel input end (ILCH) is connected to an input end of a buffer, more preferably 6[dB] buffer, through a resistor R1, so an output of the buffer B2 becomes an output of a main L channel. Likewise, a R (right) channel input end (IRCH) is connected to an input end of a buffer B3, more preferably 6[dB] buffer, through a resistor R4, so an output of the buffer B3 becomes an output of a main R channel.

Also, a sub-woofer signal is input to a buffer B1 via a sub-woofer input end (ISUB), and an output end of the buffer B1 is connected to source terminals of a pair of FETs Q1 and Q2. A drain of the FET Q1 is connected to the input end of the buffer B2 and a resistor R2 is inserted therebetween. Similarly, a drain of the FET Q2 is connected to the input end of a buffer B3 and a resistor R3 is inserted therebetween. Resistors R5 and R6 are inserted to gate terminals of FETs Q1 and Q2, which are in turn connected to a sub-woofer on/off signal terminal (ISW).

Meanwhile, to make the on/off procedure of the channel down mixing apparatus of the invention smooth, a plurality of emitter grounded NPN bipolar transistors is employed. To be more specific, when the apparatus is turned on, there is a transistor Q4, e.g., which lowers a resistance ratio (R2/R1+R2) of a signal from the ILCH; a transistor Q3, which lowers a resistance ratio (R4/R3+R4) of a signal from the IRCH; a transistor Q5, which turns on/off the transistors Q3 and Q4. For the above embodiment, a collector of the transistor Q4 is connected to a junction point of the drain terminal of the FET Q1 and the resistor R2, and a collector of the transistor Q3 is connected to a junction point of the drain of the FET Q2 and the resistor R3. A base of the transistor Q5 is connected to the sub-woofer on/off signal end (ISW), in which a resistor R9 is inserted therebetween, and a collector of the transistor Q5 is connected to a driving voltage input end (IPOS) of the transistors Q3 and Q4, in which a resistor R10 is inserted therebetween. To the IPOS a positive (+) voltage is always applied. The junction point of the collector of the transistor Q5 and the resistor R10 is connected to the bases of the transistors Q3 and Q4, respectively, having the resistors R7 and R8 therebetween.

The operational procedure of the above channel down mixing apparatus of the invention is now discussed below.

When a user turns on the sub-woofer speaker for sound output through a key input that is exposed to an instrument panel of the car, a negative (−) voltage is applied to the sub-woofer on/off signal end (ISW). Then, the FETs Q1 and Q2 as well as the transistor Q5 are turned off. On the other hand, the transistors Q3 and Q4 that receive a positive (+) voltage from the IPOS are turned on. As a result, an L channel input signal goes down to a lower level, e.g., ½ with respect to the resistance ratio (R2/R1+R2), and is input to the buffer B2 where the signal is amplified to its original level before being output. Similarly, an R channel input signal goes down to a lower level, e.g., ½ with respect to the resistance ratio (R4/R3+R4), and is input to the buffer B2 where the signal is amplified to its original level before being output. Therefore, when the sub-woofer signal is output, the down mixing operation does not occur.

On the other hand, when the user does not select the sub-woofer speaker, a positive (+) voltage is applied to the sub-woofer on/off signal end (ISW). Then, the FETs Q1 and Q2 as well as the transistor Q5 are turned on. On the contrary, the transistors Q3 and Q4 that receive a negative (−) voltage from the IPOS are turned off. Accordingly, the sub-woofer signals (ISUB) are mixed with the L channel input signals (ILCH) and the R channel input signals (IRCH), respectively, and then input to the buffers B2 and B3.

In conclusion, the channel down mixing apparatus for a car audio system of the invention can be advantageously used in that it reduces manufacture cost and switching noise by implementing the sub-woofer down mixing portion, the buffer portion and the switching circuit portion to one body with usage of simple circuit elements therefor.

While the invention has been described in conjunction with various embodiments, they are illustrative only. Accordingly, many alternative, modifications and variations will be apparent to persons skilled in the art in light of the foregoing detailed description. The foregoing description is intended to embrace all such alternatives and variations falling with the spirit and broad scope of the appended claims.

What is claimed is:

1. A channel down mixing apparatus for a car audio system, which has a channel down mixing function for down mixing a sub-woofer signal to an L (left) channel and an R (right) channel when a user does not select a sub-woofer speaker on/off signal terminal, the apparatus comprising:

a pair of buffers that amplify an L channel input signal and an R channel input signal to a designated gain, respectively, in which a resistor is serially provided before each respective buffer;

a pair of FETs that mix the sub-woofer signal with the L channel input signal and the R channel input signal when the user does not select the sub-woofer speaker on/off signal terminal, and output a mixed signal to each of the buffers;

a pair of parallel resistors connected in parallel to the serial resistors that are inserted between an output end of each of the FETs and an input end of each of the buffers;

a first transistor being configured to be turned on when the user turns on the sub-woofer speaker on/off signal terminal; and a second transistor and a third transistor, which are configured to be turned off when the first transistor is turned on and turned off when the first transistor is turned on, thereby reducing the L channel input signal and the R channel input signal to a designated level, respectively.

2. The channel down mixing apparatus for a car audio system according to claim 1, wherein the sub-woofer signal inputs to each source terminals of the FETs.

3. The channel down mixing apparatus for a car audio system according to claim 1, wherein the sub-woofer speaker on/off signal terminal is connected to each gate terminals of the FETs.

4. The channel down mixing apparatus for a car audio system according to claim 3, wherein the sub-woofer speaker on/off signal terminal is further connected to a base terminal of the first transistor.

5. The channel down mixing apparatus for a car audio system according to claim 1, wherein a driving voltage input end is connected to a collector of the first transistor.

6. The channel down mixing apparatus for a car audio system according to claim 5, wherein the driving voltage input end is further connected to each gate terminal of the second and third transistors.

7. The channel down mixing apparatus for a car audio system according to claim 1, wherein the first, second and third transistors are NPN bipolar transistors.

8. A channel down mixing apparatus for a car audio system, which has a channel down mixing function for down mixing a sub-woofer signal to an L (left) channel and an R (right) channel when a user does not select a sub-woofer speaker, the apparatus comprising:

a pair of buffers that amplify an L (left) channel input signal and an R (right) channel input signal to a designated gain, in which a resistor is serially inserted before the respective buffers;

a pair of FETs that mix the sub-woofer signal with the L channel input signal and the R channel input signal when the user does not select the sub-woofer speaker, and output a mixed signal to each of the buffers;

a pair of parallel resistors connected in parallel to the serial resistors that are inserted between an output end of each of the FETs and an input end of each of the buffers;

a first transistor configured to be turned on when the user turns on the sub-woofer speaker; and a second transistor and a third transistor, which are configured to be turned off when the first transistor is turned on and turned off when the first transistor is turned on, wherein the second and third transistors earth each of the parallel resistors when turned on, thereby reducing the level of the L channel input signal and the R channel input signal by a resistance ratio of the serial resistor to the parallel resistor.

9. The channel down mixing apparatus for a car audio system according to claim 8, wherein the sub-woofer signal inputs to each source terminals of the FETs.

10. The channel down mixing apparatus for a car audio system according to claim 8, wherein the sub-woofer speaker on/off signal terminal is connected to each gate terminals of the FETs.

11. The channel down mixing apparatus for a car audio system according to claim 10, wherein the sub-woofer speaker on/off signal terminal is further connected to a base terminal of the first transistor.

12. The channel down mixing apparatus for a car audio system according to claim 8, wherein a driving voltage input end is connected to a collector of the first transistor.

13. The channel down mixing apparatus for a car audio system according to claim 12, wherein the driving voltage input end is further connected to each gate terminal of the second and third transistors.

14. The channel down mixing apparatus for a car audio system according to claim 8, wherein the first, second and third transistors are NPN bipolar transistors.

* * * * *